US008177383B2

(12) United States Patent
Reuben

(10) Patent No.: US 8,177,383 B2
(45) Date of Patent: May 15, 2012

(54) HIGH INTENSITY NARROW SPECTRUM LIGHT EMITTING SHOE FOR PHOTODYNAMIC INACTIVATION OF FLOOR BORNE STAPHYLOCOCCUS

(76) Inventor: David Isidore Reuben, Las Vegas, NV (US)

( * ) Notice: Subject to any disclaimer, the term of this patent is extended or adjusted under 35 U.S.C. 154(b) by 0 days.

(21) Appl. No.: 13/073,577

(22) Filed: Mar. 28, 2011

(65) Prior Publication Data

US 2011/0170311 A1 Jul. 14, 2011

Related U.S. Application Data

(63) Continuation of application No. 12/198,310, filed on Aug. 26, 2008, now abandoned.

(51) Int. Cl.
*F21V 21/08* (2006.01)

(52) U.S. Cl. ..... 362/103; 362/231; 362/249.02; 36/137

(58) Field of Classification Search ..... 362/84, 362/103, 228, 230, 231, 240, 241, 243–248, 362/249.01, 249.02, 249.05, 249.12, 276, 362/294, 310, 320, 326, 327, 341, 355, 800, 362/802; 36/136, 137
See application file for complete search history.

(56) References Cited

U.S. PATENT DOCUMENTS

| | | | | |
|---|---|---|---|---|
| 4,020,572 | A * | 5/1977 | Chiaramonte, Jr. | 36/137 |
| 4,848,009 | A * | 7/1989 | Rodgers | 36/137 |
| 4,981,651 | A * | 1/1991 | Horng | 422/24 |
| 5,500,635 | A * | 3/1996 | Mott | 340/323 R |
| 5,502,903 | A * | 4/1996 | Barker | 36/137 |
| 5,919,422 | A * | 7/1999 | Yamanaka et al. | 422/121 |
| 6,050,007 | A * | 4/2000 | Angelieri et al. | 36/137 |
| 6,209,226 | B1 * | 4/2001 | Squadroni | 36/3 B |
| 6,242,752 | B1 * | 6/2001 | Soma et al. | 250/504 R |
| 6,579,495 | B1 * | 6/2003 | Maiden | 210/748.11 |
| 6,764,193 | B1 * | 7/2004 | Wei | 362/103 |
| 7,181,870 | B2 * | 2/2007 | Guzman | 36/137 |
| 7,255,468 | B2 * | 8/2007 | Capriola | 362/570 |
| 7,872,444 | B2 * | 1/2011 | Hamilton et al. | 320/108 |
| 7,937,856 | B2 * | 5/2011 | Cook et al. | 36/137 |
| 7,960,706 | B2 * | 6/2011 | Ullman | 250/455.11 |

FOREIGN PATENT DOCUMENTS

JP 2004049888 A * 2/2004

* cited by examiner

*Primary Examiner* — Hargobind S Sawhney

(57) ABSTRACT

A shoe which emits a high intensity narrow spectrum light out the bottom of the sole and sanitizes the floor directly underneath from staph bacteria.

23 Claims, 10 Drawing Sheets

HIGH INTENSITY NARROW SPECTRUM LIGHT EMITTING SHOE FOR PHOTODYNAMIC INACTIVATION OF FLOOR BORNE STAPHYLOCOCCUS

REFERENCE TO RELATED APPLICATIONS

This is a continuation of application Ser. No. 12/198,310 filed Aug. 26, 2008 now abandoned.

DRAWINGS

Figures

Figure 1:
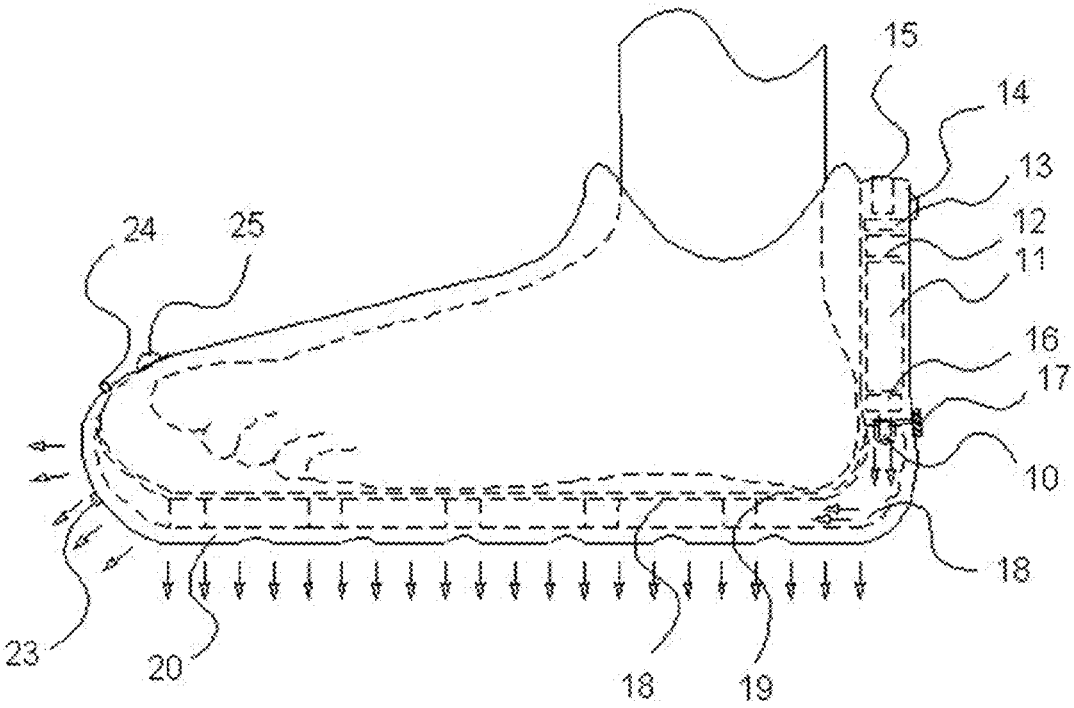
Figure 2:
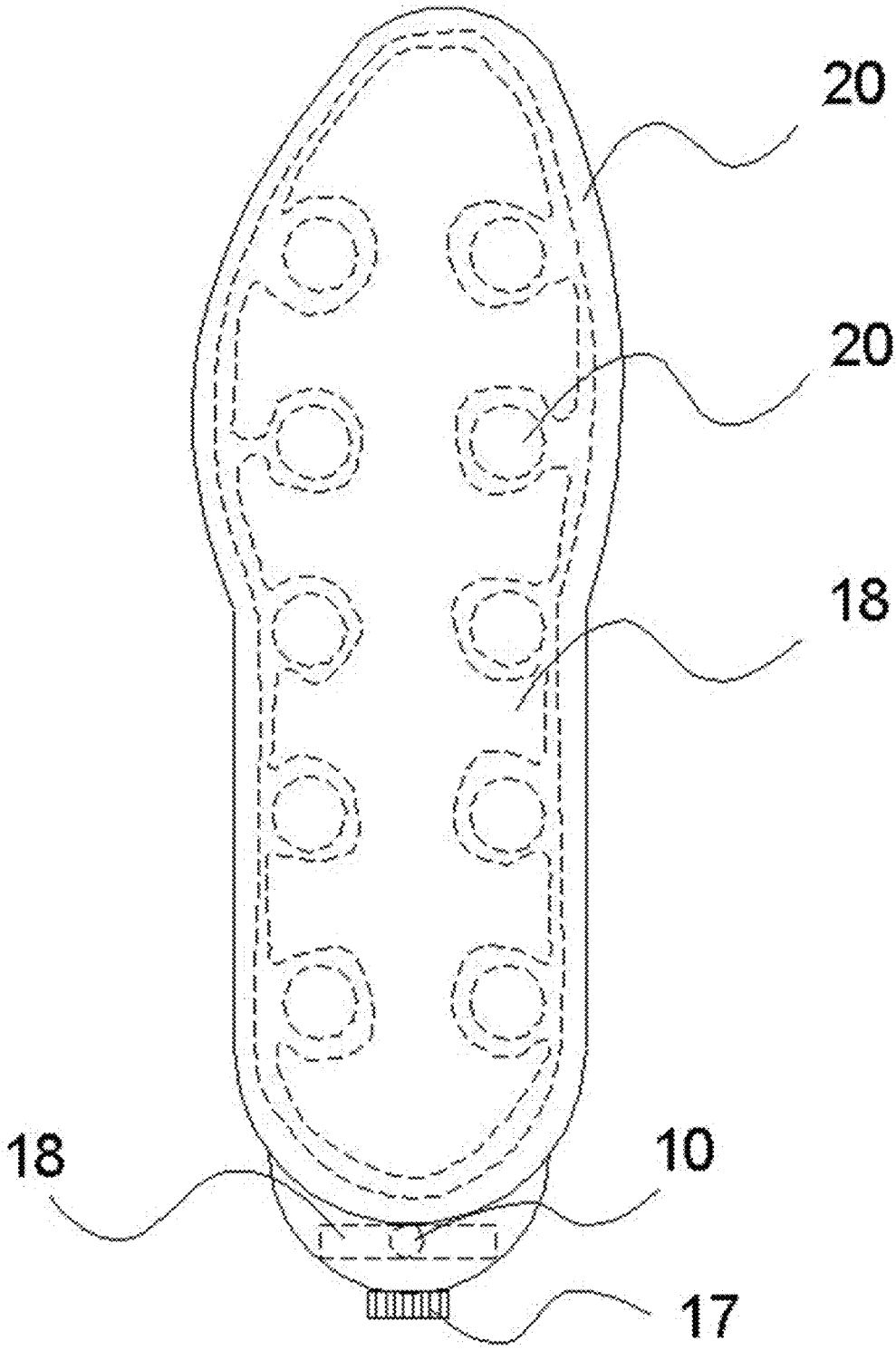
Figure 3:
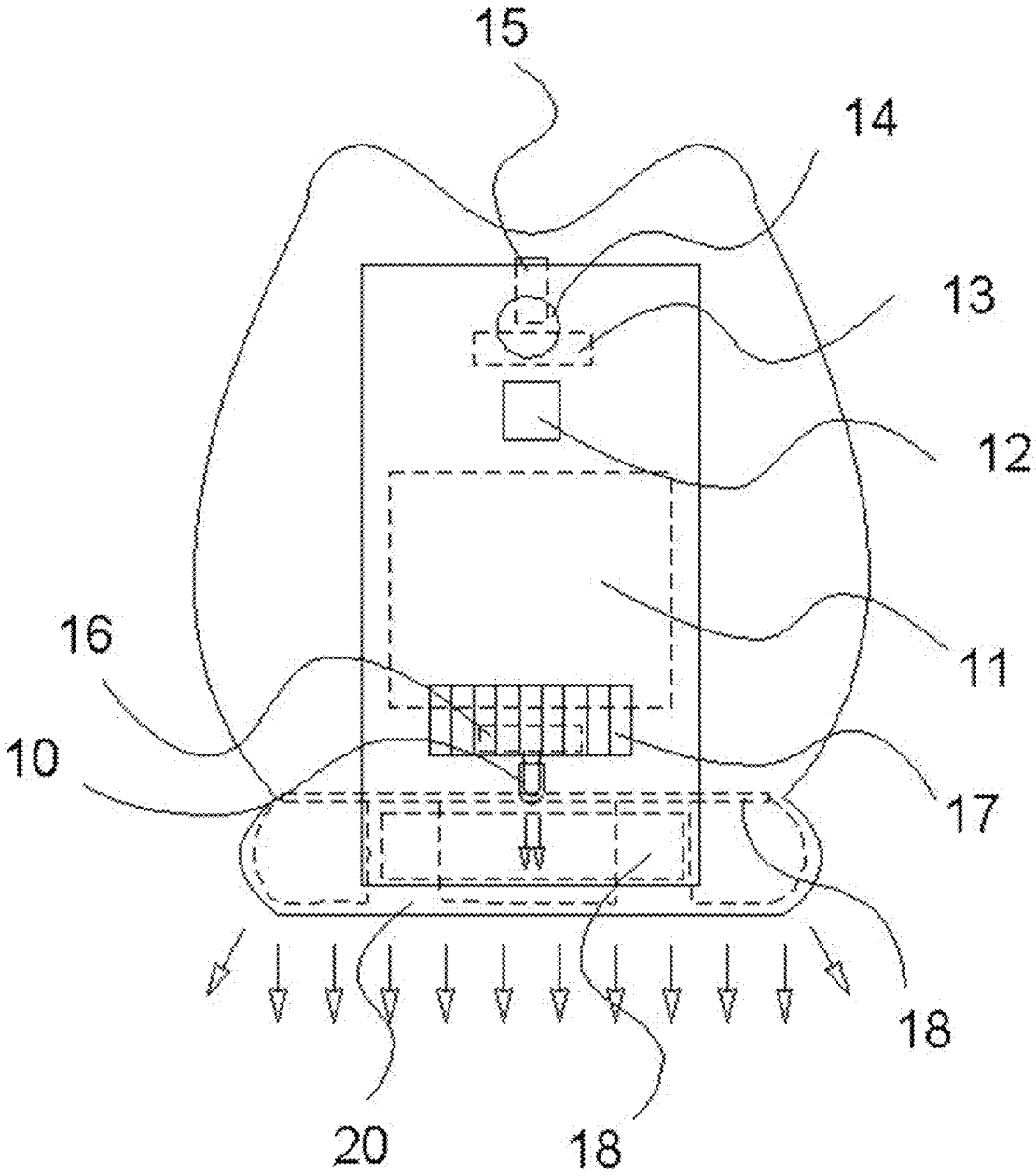
Figure 4:
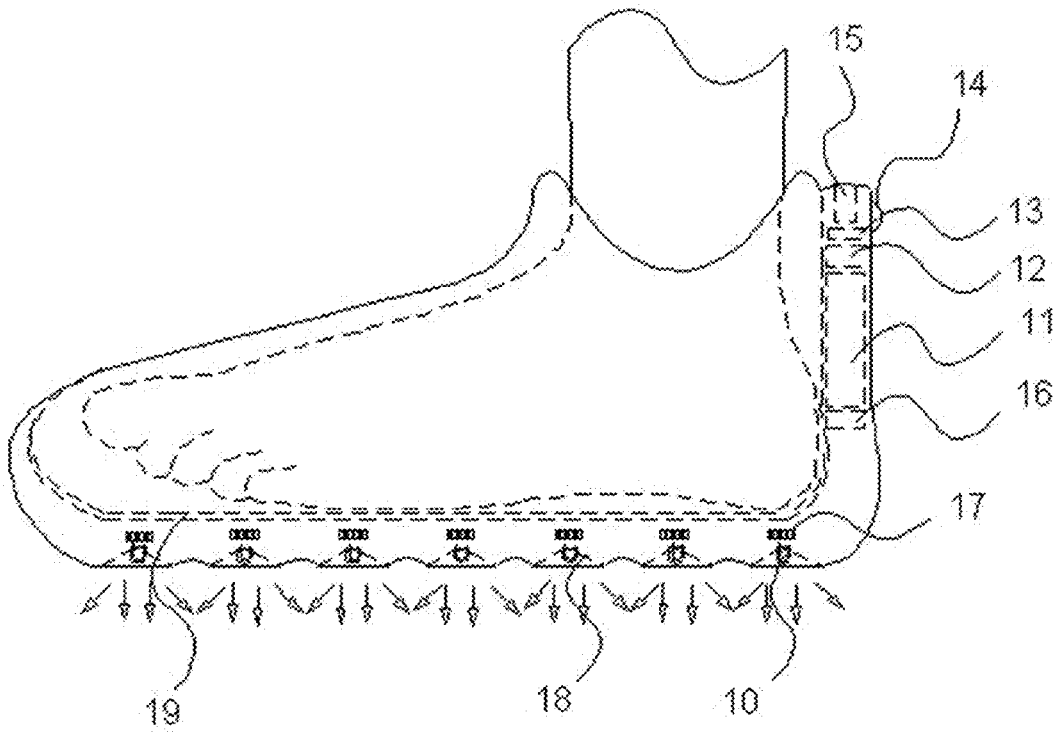
Figure 5:
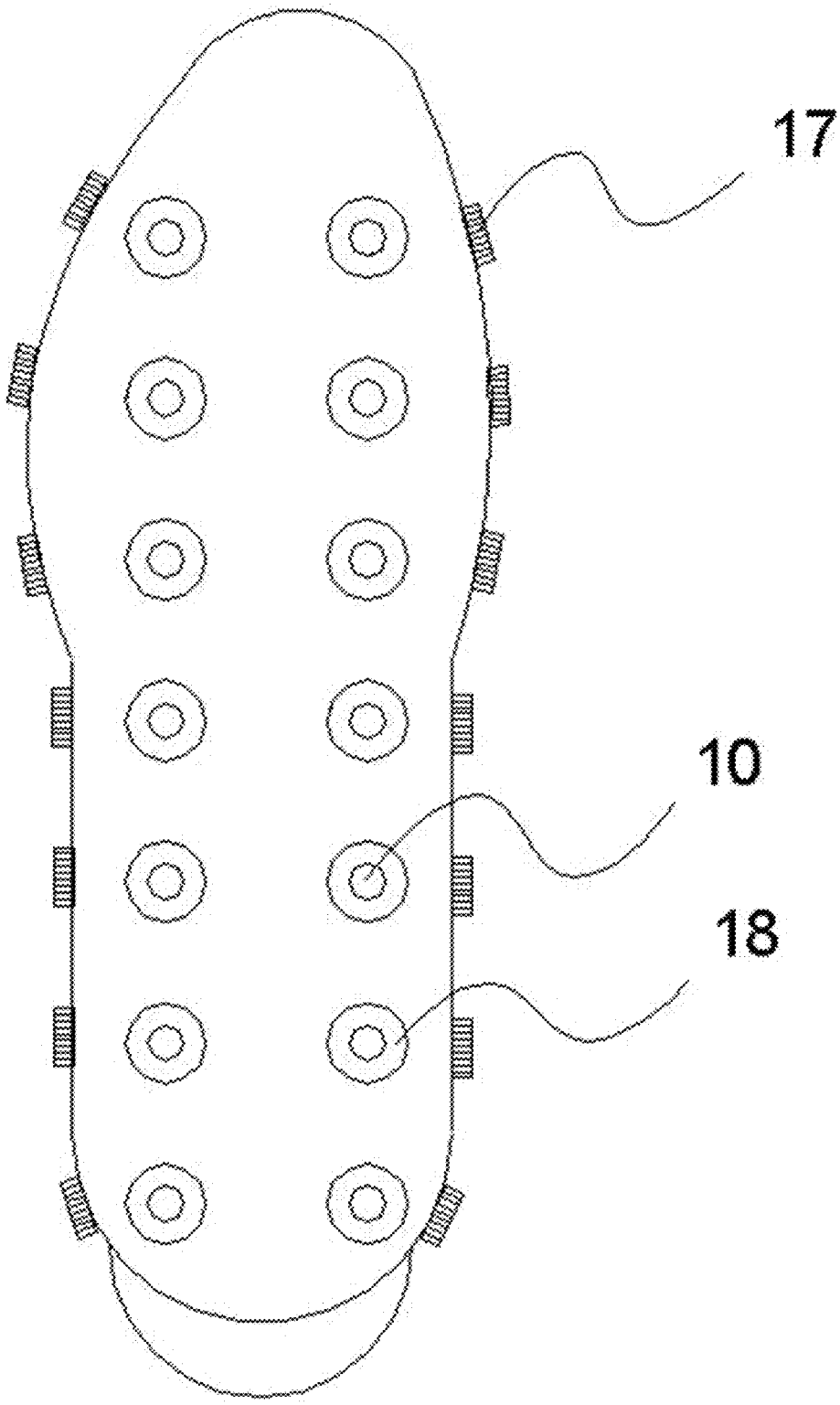
Figure 6:
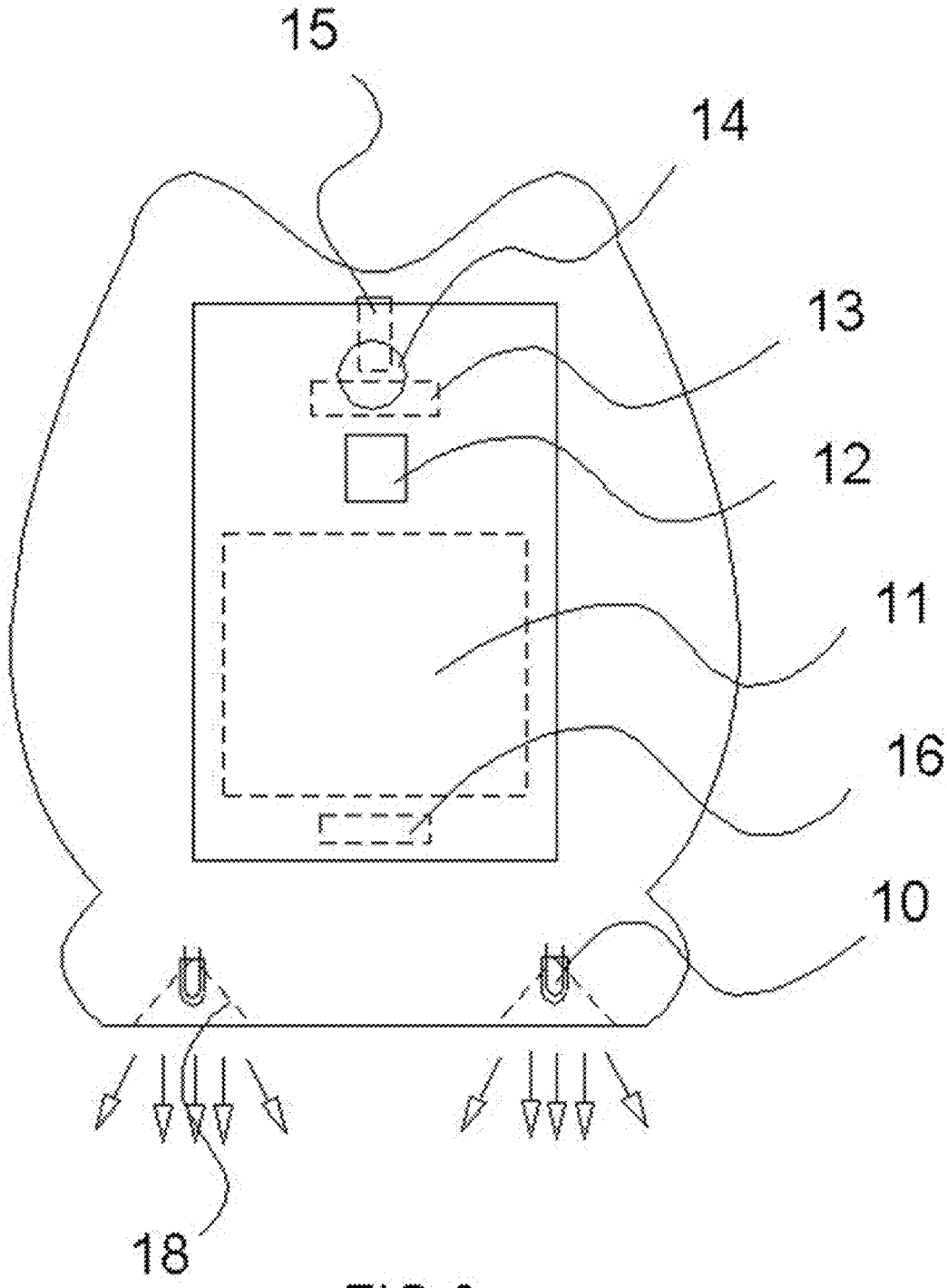
Figure 7:
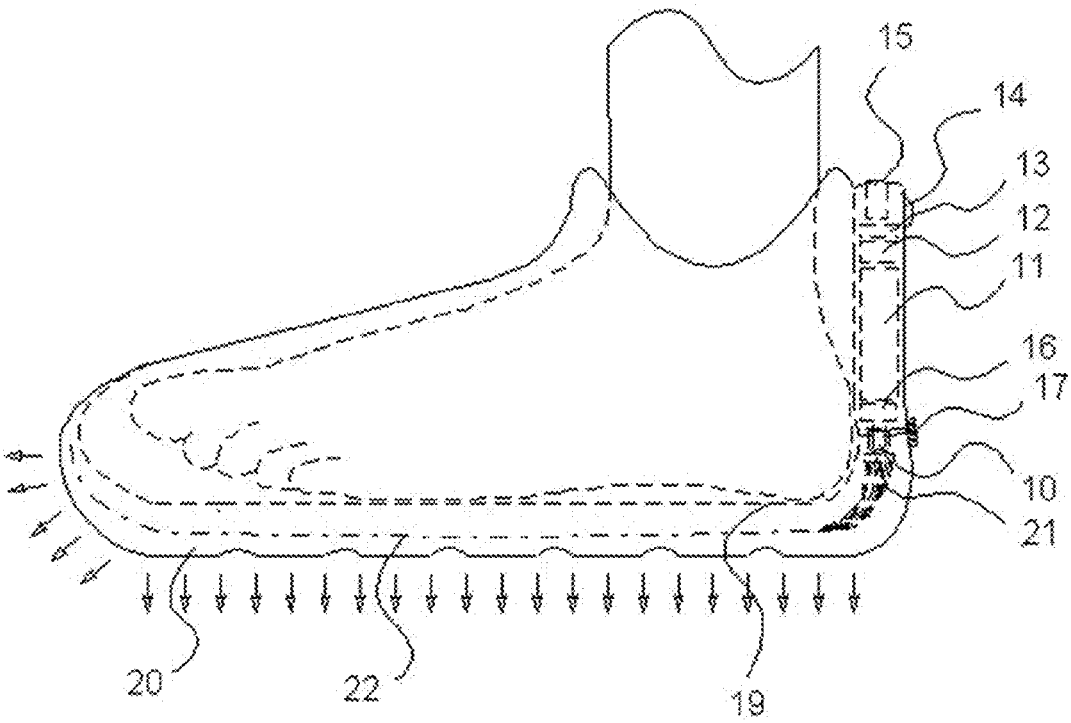
Figure 8:
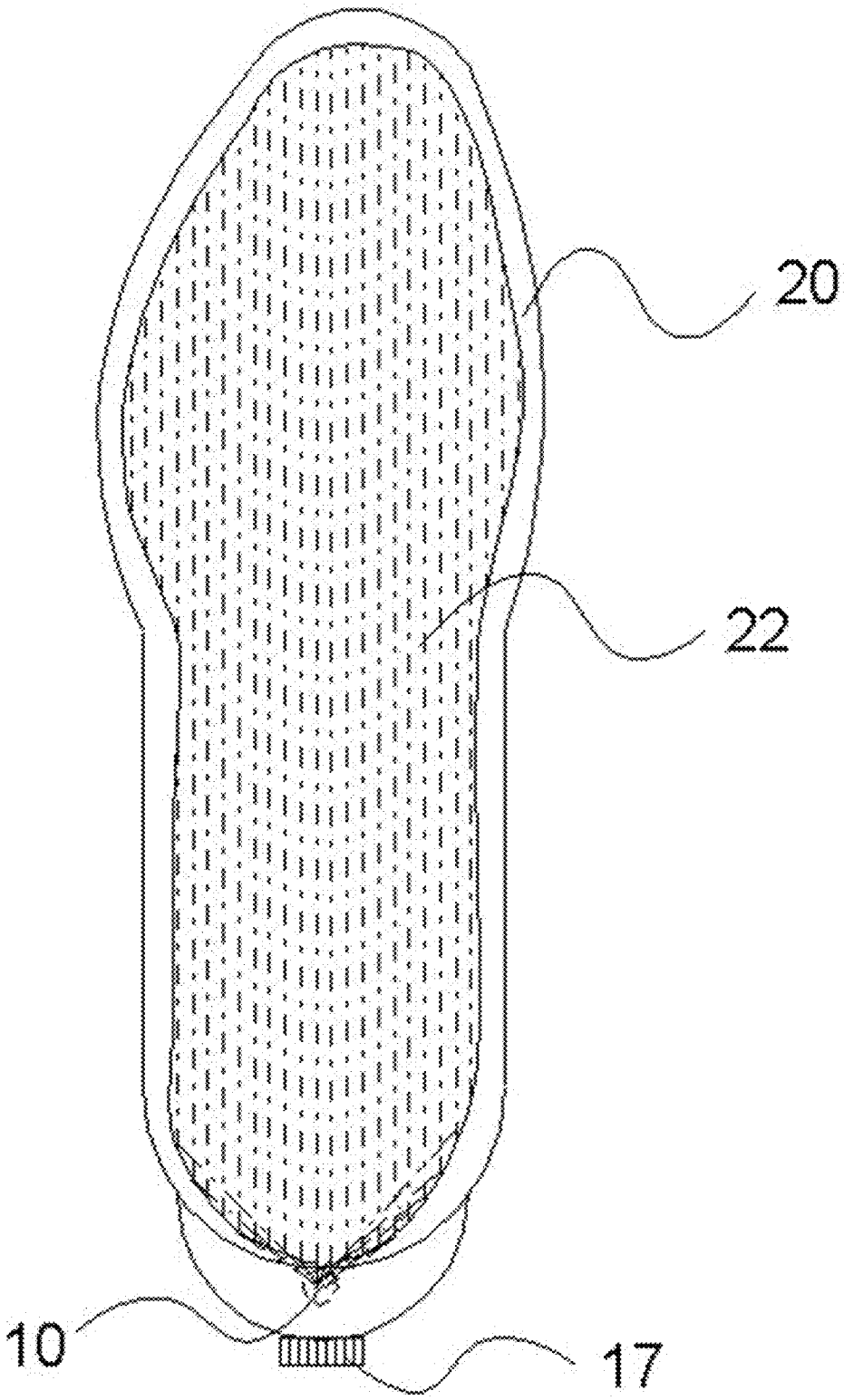
Figure 9:
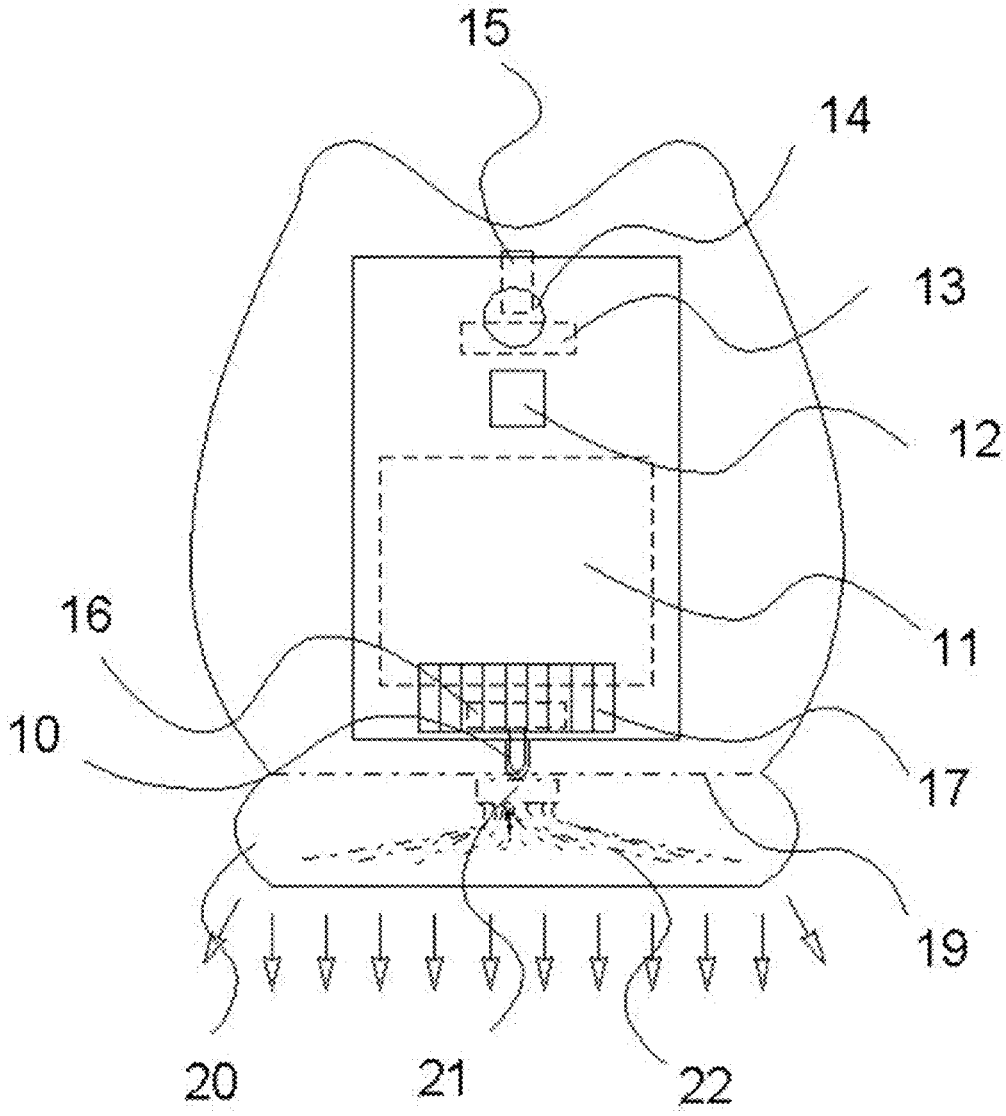
Figure 10:
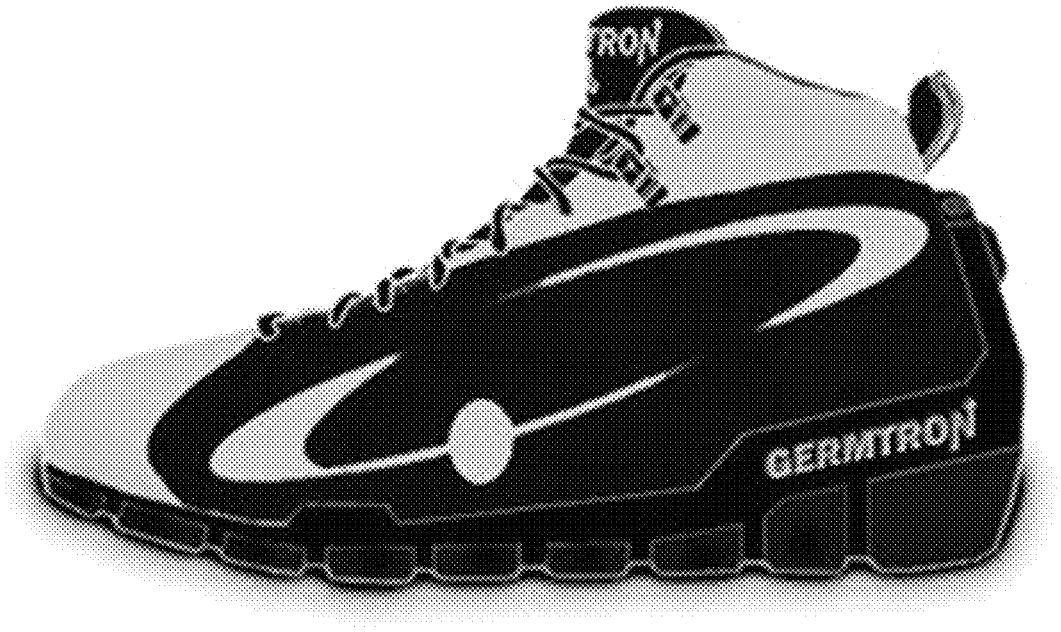
Figure 10:
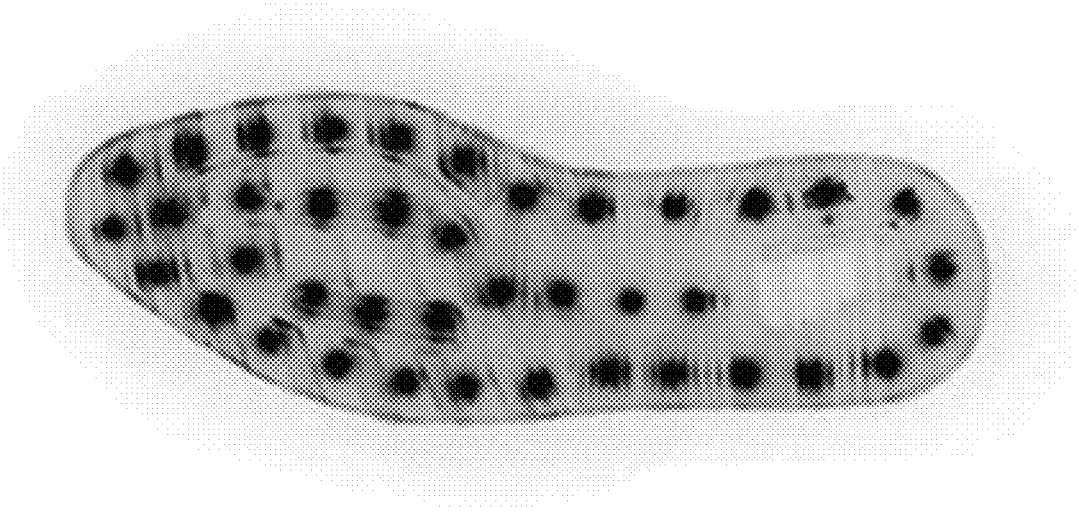

FIG. 1 Shoe Side Configuration A
FIG. 2 Shoe Bottom Configuration A
FIG. 3 Shoe Back Configuration A
FIG. 4 Shoe Side Configuration B
FIG. 5 Shoe Bottom Configuration B
FIG. 6 Shoe Back Configuration B
FIG. 7 Shoe Side Configuration C
FIG. 8 Shoe Bottom Configuration C
FIG. 9 Shoe Back Configuration C
FIG. 10 Non Line Drawing Embodiment of the Shoe

REFERENCE NUMERALS

10 High Intensity LED Module
11 Battery
12 Remote Control Switch
13 Timer
14 Pushbutton
15 Power Adapter Socket
16 Relay
17 Heat Sink
18 Reflective Surface
19 Opaque Surface
20 Wavelength Transmissive Polymer
21 Micro lens
22 Fiber Optic Strands
23 Floor Proximity Sensor
24 Indicator LED
25 Motion Sensor

BACKGROUND OF THE INVENTION

In November 2010 the applicant has learned that studies are showing that light at 405 nm (violet) just above the ultraviolet cutoff (400 nm) are proving effective at inactivating staph bacteria (staphylococcus aureus) and MRSA (methicillin resistant staphylococcus aureus), (University of Strathclyde, Light Technology Combats Hospital Infections, Photonics Spectra Newsletter, Nov. 15, 2010).

Since the applicant was already working on a shoe which emits light out the bottom of the sole for sanitization purposes, the applicant has decided to move forward with development of a shoe product which emits light at 405 nm and sanitizes the floor from staph bacteria and MRSA intended for nosocomial healthcare professionals.

DETAILED DESCRIPTION

FIGS. 1, 2, and 3

Configuration A

FIG. 1 shows the side profile of the shoe in configuration A. In this configuration a single LED module 10 in the heel of the shoe irradiates downward onto a reflector 18. The module 10 can have one or several LED chips in it. The light is reflected into a cavity in the sole and then reflected downward by a reflective coating 18 at the top of the sole. The light then propagates through the transmissive polymer 20 and onto the floor. The foot is shielded from the light by opaque barrier 19.

The circuit is powered by battery 11 in the heel. Control electronics including timer 13, remote control switch 12, and pushbutton 14 are shown in the heel. Since high intensity LED modules can run currents too high for ICs, a relay 16 is used and is shown in the heel. Since these same modules can produce considerable heat, a heat sink 17 is used and is integrated into the heel.

Even though the light emanating from the bottom of the sole can be seen, additional indication means may be needed and so an indicator LED 24 is shown at the top of the toe.

In order to conserve power and as an additional safety interlock a floor proximity sensor 23 may be used and is shown integrated into the toe.

As a means of recharging the battery 11 and/or powering the circuit, a power adapter socket 15 is used and is shown in the heel of the shoe.

FIG. 2 shows the bottom of the sole in configuration A. The sole is made of the transmissive polymer 20. Columns made of this polymer in the sole provide support and create a cavity within the sole. The top of this cavity is coated with a reflective material 18. The light from the LED module 10 is reflected by reflector 18 into the cavity and then reflected again downward through the transmissive polymer 20 and onto the floor. Heat sink 17 dissipates the heat from the module.

FIG. 3 shows the back of the heel of the shoe in configuration A. LED module 10 is shown irradiating downward onto reflector 18. Position of battery 11 and control electronics components is shown. The sole made of transmissive polymer 20 is shown with internal support columns and top reflective coating 18.

FIGS. 4, 5, and 6

Configuration B

FIG. 4 shows the side profile of the shoe in configuration B. In this configuration several LED modules 10 are integrated directly into the sole. These modules are shown irradiating the floor directly. The foot again is shielded from any light by opaque barrier 19. The circuit is powered by battery 11 in the heel. Since the current to drive all the emitters may be too high for ICs, a relay 16 is used and is shown in the heel. Control electronics and power adapter plug 15 are once again shown in the heel.

FIG. 5 shows the bottom of the sole in configuration B. The LED modules 10 are shown integrated into the sole. The top of the cavities in the sole that house the emitters may be coated with reflective material 18.

Individual heat sinks 17 are shown for each module and are integrated into the side of the sole.

FIG. 6 shows the back of the heel in configuration B. LED modules 10 are shown in cavities in the sole and the top of these cavities are coated with reflective material 18.

Position of battery 11, relay 16, and control electronics are once again shown.

FIGS. 7, 8, and 9

Configuration C

FIG. 7 shows the side profile of the shoe in configuration C. In this configuration a single LED module 10 is used and is shown in the heel of the shoe. The module illuminates fiber optic strands 22 embedded in the sole of the shoe. A micro lens 21 difuses the light evenly onto all the strands. These fiber optic strands are side emitting and so the light propagates through the sole made of transmissive polymer 20 and onto the floor. The foot is once again shielded from any light by opaque barrier 19. Location of power and control electronics is unchanged from configurations A and B.

FIG. 8 shows the bottom of the sole in configuration C. The side emitting fiber optic strands 22 are shown running the length of the sole and are embedded in the transmissive polymer 20. The single LED module 10 which illuminates them is shown in the heel. Location of heat sink 17 is once again shown.

FIG. 9 shows the back of the heel in configuration C. The single LED module 10 which illuminates side emitting fiber optic strands 22 through micro lens 21 are shown. Location of battery 11 and control electronics are shown and are unchanged from configurations A and B.

FIG. 10

FIG. 10 shows a non line drawing embodiment of the proposed shoe. Germtron™, the applicant's proprietary brand name is shown embossed on the product along with original artwork.

The sole of the shoe shown is an actual working prototype and shows LEDs embedded in a light transmissive sole.

The battery and control electronics are shown to be in the heel of the shoe. For aesthetic purposes the shoe is designed to appear to be an ordinary sneaker. This is of course until the light is turned on and illuminates the floor.

Operation

The proposed shoe is intended to have the physical characteristics and appearance of an ordinary sneaker. The germicidal function of the shoe is intended to be conveyed via graphics and logos on the shoe.

The battery and control electronics do add bulk and weight to the shoe however that is intended to be minimized as much as technology permits.

Although a consumer version is certainly plausible the target customers for this product are nosocomial healthcare professionals and administrators who are concerned about the spread of staph bacteria and MRSA through footwear at their facilities.

The shoe would be purchased as one would purchase an ordinary shoe based on size, gender, and style. In a rechargeable embodiment the shoes would come with a plug in or induction recharger. The user of the shoe would charge up the shoe and then wear it as they would an ordinary shoe.

During the course of the users rounds there would be times when they would want to activate the sanitizing function in order to either sanitize the floor or the outside bottom of the sole. This would be for instance when the user is about to enter a surgical or recovery room. They would then either press the push button on the shoe or the button on a keyfob remote to turn on the sanitizing light. Automatic activations by fixed remote control transmitters or sensors on board the shoe do fall under the scope of the functionality of the device. The light emitted onto the floor is directly actinic and inactivates staph bacteria by either damaging their DNA or exciting molecules within the bacteria. The kill ratio for the device is a function of time so the longer the light is on the more of the staph bacteria is inactivated.

Once the sanitizing cycle is activated its duration is governed by a timer in the shoe. Additional controls such as the floor proximity sensor, foot presence sensor, and motion sensor can be integrated to activate or deactivate sanitizing cycles in order to conserve power and as safety interlocks.

The user can wear the shoe throughout the course of their day and then remove the shoes and plug them in or set them on the induction recharger in order to recharge them.

An indicator LED may be integrated into the shoe to indicate the status of sanitizing cycles or the integrity of battery charge or both.

What is claimed is:

1. A shoe for photodynamically sanitizing the floor comprising:

A shoe embodying one or more built-in LEDs configured to emit incident light out the bottom of the sole and onto the floor directly underneath, the emitted wavelength being a resonant frequency of DNA at or near 265 nm or a molecular excitation frequency at or near 405 nm a DC power source on board the shoe coupled to the LEDs and operable to provide power to the LEDs, wherein the irradiance on said floor is effectively antimicrobial.

2. The shoe in claim 1 wherein the emitters are one or more LED modules in the heel of the shoe.

3. The shoe in claim 1 wherein the emitters are one or more LED modules in the sole of the shoe.

4. The shoe in claim 1 wherein power is supplied from a battery embedded in the back of the heel of the shoe.

5. The battery in claim 4 wherein the battery is recharged by a plug-in adapter.

6. The battery in claim 4 wherein the battery is recharged by induction.

7. The battery in claim 4 wherein the said battery is replaceable.

8. The shoe in claim 1 wherein power is supplied from a plug-in adapter.

9. The shoe in claim 1 wherein the light is propagated via fiber optics.

10. The shoe in claim 1 wherein the light is propagated via a reflector or plurality of reflectors.

11. The reflector in claim 10 wherein the said reflector is made of polished aluminum.

12. The shoe in claim 1 wherein the sole is made of a polymer transmissive at the applicable wavelength.

13. The shoe in claim 1 wherein the foot is insulated from the light emitting sole by an opaque barrier.

14. The shoe in claim 1 wherein sanitizing cycles are activated by a push button on the shoe.

15. The shoe in claim 1 wherein sanitizing cycles are activated by remote control.

16. The shoe in claim 1 wherein the duration of sanitizing cycles is governed by a timer embedded in the shoe.

17. The timer in claim 16 wherein the said timer is a microprocessor controller.

18. The shoe in claim 1 wherein the light emitted is digitally pulsed.

19. The shoe in claim 1 wherein sanitizing cycles are activated by a floor proximity sensor or switch.

20. The shoe in claim 1 wherein sanitizing cycles are activated or deactivated by a motion sensor on board the shoe.

21. The shoe in claim 1 wherein a colored LED on the shoe indicates the status of sanitizing cycles.

22. The shoe in claim 1 wherein an colored LED on the shoe indicates the integrity of the battery charge.

23. The shoe in claim 1 wherein heat from the emitters is dissipated via one or more heat sinks on the shoe.

* * * * *